US010758916B2

(12) United States Patent
Zhu et al.

(10) Patent No.: US 10,758,916 B2
(45) Date of Patent: Sep. 1, 2020

(54) APPLICATION METHOD AND DEVICE FOR COLD FIELD PLASMA DISCHARGE ASSISTED HIGH ENERGY BALL MILLED POWDER

(71) Applicant: South China University of Technology, Guangzhou (CN)

(72) Inventors: Min Zhu, Guangzhou (CN); Meiqin Zeng, Guangzhou (CN); Zhongchen Lu, Guangzhou (CN); Liuzhang Ouyang, Guangzhou (CN); Hui Wang, Guangzhou (CN); Renzong Hu, Guangzhou (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 340 days.

(21) Appl. No.: 15/539,360

(22) PCT Filed: Dec. 24, 2014

(86) PCT No.: PCT/CN2014/094856
§ 371 (c)(1),
(2) Date: Jun. 23, 2017

(87) PCT Pub. No.: WO2016/101187
PCT Pub. Date: Jun. 30, 2016

(65) Prior Publication Data

US 2017/0348699 A1 Dec. 7, 2017

(51) Int. Cl.
*B02C 19/18* (2006.01)
*B22F 9/14* (2006.01)
(Continued)

(52) U.S. Cl.
CPC ..... *B02C 19/18* (2013.01); *B02C 17/14* (2013.01); *B02C 17/18* (2013.01); *B22F 9/14* (2013.01); *B02C 17/1875* (2013.01); *B02C 19/16* (2013.01)

(58) Field of Classification Search
CPC ..... B02C 17/14; B02C 17/18; B02C 17/1875; B02C 19/16; B02C 19/18; B22F 9/14
(Continued)

(56) References Cited

U.S. PATENT DOCUMENTS 6,126,097 A 10/2000 Chen et al.
6,334,583 B1 1/2002 Li
(Continued)

FOREIGN PATENT DOCUMENTS

CN 1718282 * 1/2006 ..... B02C 17/14
CN 1718282 A 1/2006
(Continued)

OTHER PUBLICATIONS

International Search Report for No. PCT/CN2014/094856 dated Jul. 20, 2015.

*Primary Examiner* — Jessee R Roe
*Assistant Examiner* — Michael Aboagye
(74) *Attorney, Agent, or Firm* — The Dobrusin Law Firm, P.C.

(57) ABSTRACT

Generating plasma by using dielectric barrier discharge and introducing a dielectric barrier discharge electrode bar into a high-speed vibrating ball milling tank requires that, on one hand, a solid insulation medium on the outer layer of the electrode bar can simultaneously bear high-voltage discharge and mechanical shock failure of the grinding ball, and on the other hand, the high-speed vibrating ball milling device can uniformly process the powder. The discharge space pressure is set to a non-thermal equilibrium discharge
(Continued)

state with a pressure of about $10^2$ to $10^6$ Pa, discharge plasmas are introduced to input another kind of effective energy to the processed powder, so as to accelerate refinement of the powder to be processed and promote the alloying process and improve the processing efficiency and the effect of the ball mill.

9 Claims, 5 Drawing Sheets

(51) Int. Cl.
*B02C 17/18* (2006.01)
*B02C 17/14* (2006.01)
*B02C 19/16* (2006.01)

(58) Field of Classification Search
USPC ..... 266/137; 427/488
See application file for complete search history.

(56) References Cited

U.S. PATENT DOCUMENTS

| | | | | |
|---|---|---|---|---|
| 9,764,954 | B2 * | 9/2017 | Walters | B01J 19/088 |
| 2004/0253175 | A1 * | 12/2004 | Stiffler | C21B 11/00 423/633 |
| 2010/0183802 | A1 | 7/2010 | Eguchi et al. | |
| 2014/0105777 | A1 * | 4/2014 | Yoon | B22F 9/04 419/26 |

FOREIGN PATENT DOCUMENTS

| | | | | |
|---|---|---|---|---|
| CN | 101239334 A | | 8/2008 | |
| CN | 101239336 A | | 8/2008 | |
| CN | 102500451 A | | 6/2012 | |
| CN | 202398398 | * | 8/2012 | B02C 17/14 |
| CN | 202398398 U | | 8/2012 | |
| CN | 104549658 A | | 4/2015 | |

* cited by examiner

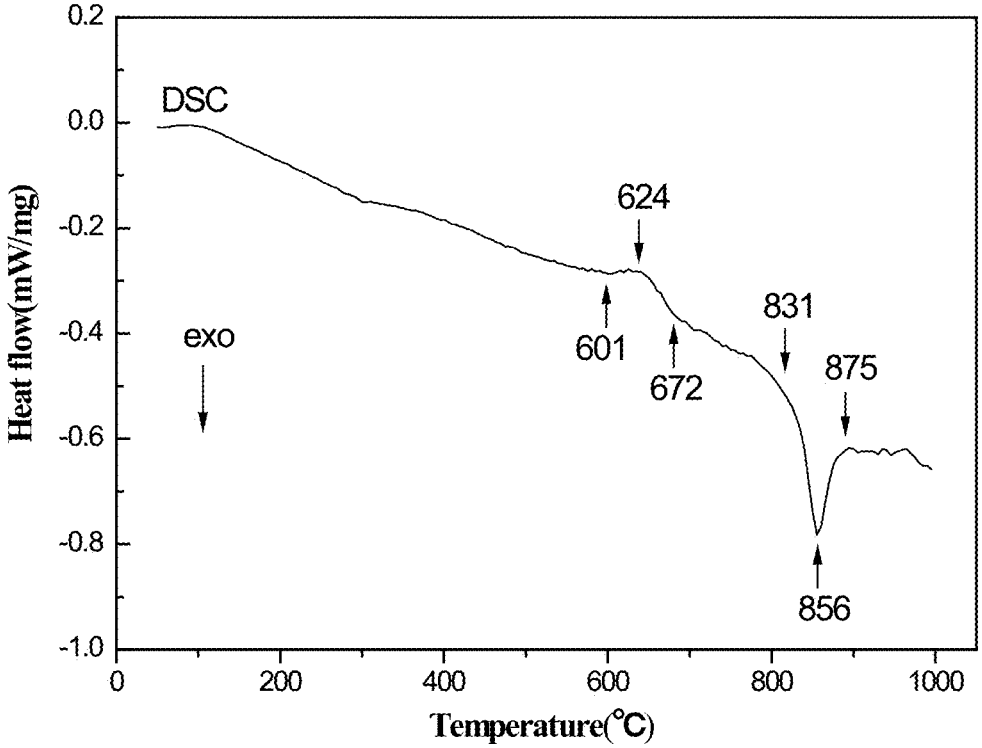
Fig. 10
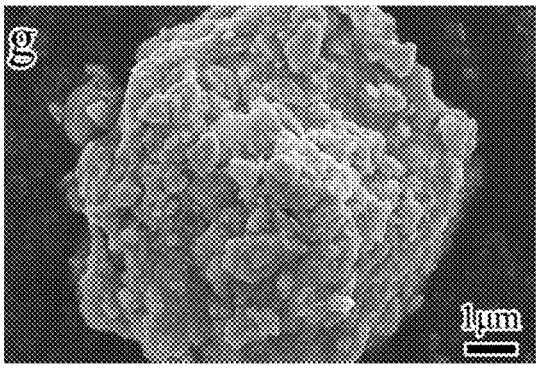
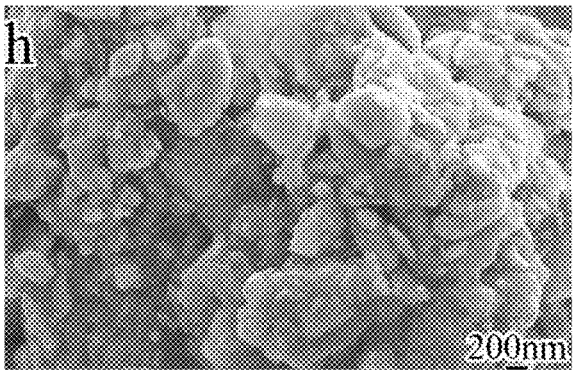
Fig. 11a
Fig. 11b

APPLICATION METHOD AND DEVICE FOR COLD FIELD PLASMA DISCHARGE ASSISTED HIGH ENERGY BALL MILLED POWDER

FIELD OF THE INVENTION

The present invention, belonging to the field of the mechanical manufacture and powder metallurgy technology, relates to a high energy ball milling device, in particular to a cold field plasma assisted high energy ball milling device and its application to preparation of cemented carbide, lithium ion batteries and hydrogen storage alloy powder materials.

BACKGROUND OF THE INVENTION

An ordinary high energy ball milling method for preparing alloy powder, as currently one of the most commonly used technologies for preparing and mechanically alloying nanomaterials and micron materials, generally refines the metal or alloy powder to a nanometer and micron scale by rotation or vibration with a high energy ball mill, that is, putting two or more kinds of powder at the same time into a ball milling tank of the high energy ball mill, and subjecting the powder particles to a repeated process of rolling, pressing, crushing and re-pressing (i.e., repeated cold welding-crushing-cold welding) to make the powder grain constantly refined and the particle size constantly reduced, thus finally obtaining the nanometer and micron ultrafine alloy powder with uniformly distributed structure and composition. Usually the high energy ball mill is used to process the powder simply through rotation or vibration of the ball milling tank, i.e., using the mechanical energy of the milling ball in the ball milling tank, that is, only the mechanical stress field works. However, the current mechanical alloying application is mainly concentrated in the planetary and agitating ball mills, having large energy consumption, low efficiency and other shortcomings.

A plasma generator typically applies a high-frequency electric field to the reaction gas environment under a negative pressure (vacuum), with the gas ionized under the excitation of a high-frequency electric field to produce plasma. These ions have high activity and energy that is sufficient to destroy almost all of the chemical bonds and cause chemical reactions on any exposed material surface, resulting in changes in the structure, composition and groups of the material surface to produce a surface that meets the actual requirements. In addition, the plasma has a fast reaction speed and high processing efficiency, with the modification only occurring on the material surface and having no effect on the performance of the material inside, and is thus an ideal means of surface modification. Plasma surface modification has been widely used in film-like, bulk, granular and other materials, and materials of different shapes have to be subjected to different plasma treatments; for example, for film-like materials (including films, fabrics, non-woven fabrics, wire meshes, etc.), since they can be packed in rolls, they can be processed in a roll-to-roll batch; bulk materials can be placed one by one, and so they are suitable for multi-layer plate electrode processing. However, plasma is seldom used for processing powder particles, and especially the introduction of plasma into the high energy ball milling device is more difficult, which is mainly due to the following two aspects: first, due to the accumulation of powder and the agglomeration among particles, the surface of the particles without exposure to the plasma atmosphere cannot be processed, and it is difficult to get all the particles processed, resulting in incomplete and nonuniform particle processing and a poor processing effect; second, the discharge electrode is seriously damaged under the combined action of the high-speed collision and the high-voltage discharge of the grinding ball in the high energy ball milling tank, thus having a very short life in the ball milling tank. Therefore, there is an urgent need for a plasma assisted high energy ball milling device for processing powder materials.

A patent CN 1718282 A, disclosing a plasma assisted high energy ball milling method, mainly introduced how to achieve and improve the plasma discharge assisted ball milling effect on the basis of an ordinary ball mill, but did not further disclose the specific structure of a main engine of the ball mill or the structure design of the discharge ball milling tank, in particular the material selection and design of the dielectric barrier discharge electrode bar. In fact, the plasma assisted high energy ball mill has various technical problems with the external plasma power supply, the discharge ball milling tank, the dielectric barrier discharge electrode bar and the like, and especially has mutual fitting, local high intensity breakdown discharge, plasma discharging current strength control and other issues in the process of introducing the electrode bar into the ball milling tank, and the electrode bar itself is limited by the various problems affecting life that are caused by the material and structure, which are not resolved by the above invention patent.

Patents CN 101239334 A and CN 1011239336 A respectively disclosed a plasma assisted high energy roller ball milling device and a plasma assisted agitating ball milling device, which were primarily obtained by modification on the conventional roller and agitating ball mill; however, these two ball mills have small mechanical energy and low ball milling efficiency, not only difficult to regulate the ball milling energy in a wide range, but also unsuitable for the plasma assisted high efficient refining effect. The vibrating ball milling device can regulate the ball milling energy in a wide range simultaneously from both the amplitude of the excitation block and the speed of the ball mill.

A patent CN 101239335 A disclosed a plasma assisted high energy planetary ball milling device, which improves the ball milling efficiency of the planetary ball mill based on the traditional planetary ball mill by introducing an electrode bar with an external plasma power supply into the planetary ball milling tank. However, since the planetary ball mill has to achieve rotation and revolution of the ball milling tank, the electrode introduced into the ball milling tank is extremely unstable; in addition, the electrode bar installed in the ball milling tank has a serious hindrance to the collision of the grinding ball, which weakens the ball milling advantage of the planetary structure.

Patents CN 102500451 A and CN 202398398 U disclosed an assisted ball milling dielectric barrier discharge electrode bar, which was provided on the tubular conductive electrode layer with a tubular polytetrafluoroethylene barrier dielectric layer, removing the thread fitting between the two tubes; and this electrode bar could only be applied to a ball milling tank provided at both ends with a through hole. In the actual processing and assembly process, this fitting can never avoid the damage done by the residual air to the electrode bar in the discharge process, and thus the actual life of the electrode bar cannot be greatly improved.

U.S. Pat. Nos. 6,126,097 and 6,334,583 disclosed a planetary high energy ball milling device and a method for preparing nanometer powders, and introduced the structure of an ordinary planetary ball mill and its application in the preparation of nanometer powders. However, these invention patents are limited to the field of the planetary ball mill, and do not involve the application of the external plasma electric field.

Contents of the Invention

For overcoming the drawbacks of mechanical alloying including large energy consumption, low efficiency and heavy pollution, the object of the present invention is to introduce a dielectric barrier discharge electrode bar into a high-speed vibrating ball milling tank with the dielectric barrier discharge (DBD) as a notable and unique discharge approach for generating a plasma, which requires that, on one hand, a solid insulation medium on the outer layer of the electrode bar can simultaneously bear high-voltage discharge and mechanical shock failure of the grinding ball, and on the other hand, the high-speed vibrating ball milling device can uniformly process the powder, thus providing a new type of high energy ball milling device that can efficiently improve the mechanical alloying efficiency of materials and the application method thereof for preparing cemented carbide, lithium ion batteries and hydrogen storage alloy powder materials. Based on the ordinary ball milling technology, with another kind of effective energy inputted to the processed powder by introducing discharge plasmas, the present invention accelerates refinement of the powder to be processed and promotes the alloying process under the combined action of the mechanical stress effect and the external electric field discharge for producing the plasma, thereby greatly improving the processing efficiency and the effect of the ball mill.

The present invention provides an application method for producing cold field plasma discharge assisted high energy ball milled powder, which comprises: first inputting different voltage and current to a discharge ball milling tank of a plasma assisted high energy ball milling device by using an external cold field plasma power supply, then regulating the internal atmosphere (type and pressure of a gas) of the ball milling tank through a controllable atmosphere system, and then making a discharge electrode bar in the discharge ball milling tank produce a corona or glow discharge phenomenon with controllable strength, thus realizing a plasma field high energy ball milling and assisted mechanical alloying process for the processed powder in the discharge ball milling tank.

The present invention also provides a plasma assisted high energy ball milling device using the method for the cold field plasma high energy ball milled powder, which comprises six components, i.e., a vibrating high energy ball milling main engine, an external cold field plasma power supply, a discharge ball milling tank, a discharge electrode bar, a controllable atmosphere system and a cooling system, with the vibrating high energy ball milling main engine being in the form of a vibrating mill;

the discharge ball milling tank comprises a connecting cylinder, a front cover, a rear cover, and a plasma power supply negative grounding electrode connected to the discharge ball milling tank; and the discharge electrode bar, in the form of a cylindrical rod, is composed of an inner conductive core made of iron (copper) and an outer insulation layer made of polytetrafluoroethylene; the inner conductive core, as an electrode for plasma discharge, is connected to a plasma power supply positive high-voltage electrode, and the outer insulation layer is present as a discharge dielectric barrier layer.

The plasma assisted high energy ball milling device according to the present invention is also characterized in that:

the vibrating high energy ball milling main engine is alternatively in the form of an eccentric vibrating mill;

the external cold field plasma power supply 2 converts a mains supply current into a high-frequency current by using a high-voltage AC power supply in a conversion mode of AC-DC-AC, wherein an FM control mode is used for the DC-AC conversion, the working frequency is adjustable in the range of 1-20 kHz, and the power supply output voltage is in the range of 1-30 kV; the outer insulation layer of the cylindrical rod-shaped discharge electrode bar is alternatively made of a high purity alumina ceramic material;

a tightening end of the conductive core made of iron (copper) in the discharge electrode bar threadedly fits in with the outer insulation layer made of polytetrafluoroethylene, a discharge end fits in with the outer insulation layer by having a bare rod structure, a fitting gap between the conductive core and the outer insulation layer is filled with a heat-resistant adhesive, and the top of the conductive core fits in with a medium in the outer insulation layer by having a spherical structure;

the outer insulation layer made of a high purity alumina ceramic material, composing the discharge electrode bar together with the inner conductive core made of iron (copper), is formed by a direct deposition method or a micro-arc oxidation method;

the discharge electrode bar of the outer insulation layer made of a high purity alumina ceramic material is alternatively covered with a metal sleeve with meshes;

the controllable atmosphere system, mounted above inlet and outlet holes of the discharge ball milling tank, can independently regulate ball milling effects of the plasma on the processed powder under different atmospheric pressure and in various atmospheres of argon, nitrogen, ammonia, hydrogen and oxygen; flanges on both ends of the cylinder of the discharge ball milling tank are sealedly connected to the front cover and the rear cover through a sealing ring and a bolt, respectively, with a through hole and a blind hole for fixing the discharge electrode bar provided in a central position of the front cover and the rear cover, respectively;

a stainless steel sleeve and a rubber sealing ring are embedded in the through hole of the front cover of the discharge ball milling tank, and a stainless steel sleeve gasket is embedded in the blind hole of the inner side of the rear cover; and the front cover of the discharge ball milling tank is provided on its outer end face with a vacuum valve.

For the application method for producing cold field plasma discharge assisted high energy ball milled powder according to the present invention, with the dielectric barrier discharge providing the plasma, a medium is covered on an electrode placed in the discharge space. When a sufficiently high AC voltage is applied to the discharge electrode, dielectric barrier discharge is generated to break the gas between the electrodes, or a very uniform, scattered, stable and seemingly low pressure glow discharge is formed, thus constituting a unique discharge form with a large number of fine fast pulse discharge channels. For introducing a dielectric barrier discharge electrode bar into the high-speed vibrating ball milling tank, it is required that, on one hand, a solid insulation medium on the outer layer of the electrode bar can simultaneously bear high-voltage discharge and mechanical shock failure of the grinding ball, and on the other hand, the high-speed vibrating ball milling device can uniformly process the powder, thus providing a new type of high energy ball milling device that can efficiently improve the mechanical alloying efficiency of materials and the application method thereof for preparing cemented carbide, lithium ion batteries and hydrogen storage alloy powder materials. Based on the ordinary ball milling technology, the discharge space pressure is set to a non-thermal equilibrium discharge state with a pressure of about $10^2$ to $10^6$ Pa, and discharge plasmas are introduced to input another kind of effective energy to the processed powder, so as to accelerate refinement of the powder to be processed and promote the alloying process under the combined action of the mechanical stress effect and the external discharge plasma, thereby greatly improving the processing efficiency and the effect of the ball mill.

With the following unique advantages of the dielectric barrier discharge plasma of the present invention, the dielectric barrier discharge plasma is clearly a better choice for the introduction of plasma into the high energy ball mill:

First, the dielectric barrier discharge plasma can be generated at atmospheric pressure, which meets the condition that the ball milling needs to be carried out in a protective atmosphere of a certain pressure;

second, since the dielectric layer suppresses the infinite enhancement of micro discharge, the dielectric barrier discharge will not be converted into spark discharge or arc discharge, which ensures that the plasma is not a thermal plasma having strong destructive power on materials, thereby avoiding burning of the ball milling system;

third, the dielectric barrier discharge can be spread evenly on the surface of the dielectric layer, so that the ball milled powder can evenly receive the action of the dielectric barrier discharge plasma; and finally, under certain conditions, the dielectric barrier discharge can produce quasi-glow or glow discharge, so that it is possible to achieve efficient ball milling in the reaction atmosphere, so as to accelerate refinement of the powder to be processed and promote the alloying process under the combined action of the mechanical stress effect and the external discharge plasma, thereby greatly improving the processing efficiency and the effect of the ball mill.

BRIEF DESCRIPTION OF THE DRAWINGS

FIG. 10 shows a heated scanning DSC curve of the W—C-10Co powder after being milled for 3 h by the DBDP ball milling according to the present invention; and FIGS. 11*a* and 11*b* show a scanning electron microscopic image of the W—C-10Co-1.2VC mixed powder after being milled for 3 h by the DBDP assisted high energy ball milling according to the present invention.

Figure 1A:
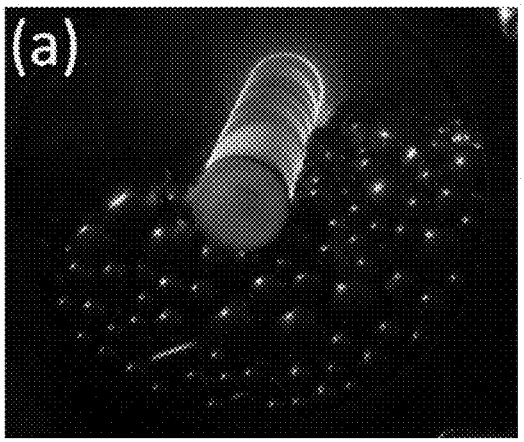
FIGS. 1*a* and 1*b* show dielectric barrier discharge plasma photographs in a static state and a ball milling state in the ball milling process of the present invention.

In the figures: 1. A vibrating high energy ball milling main engine; 2. an external cold field plasma power supply; 3. a discharge ball milling tank; 4. a discharge electrode bar; 5. a controllable atmosphere system; 6. a cooling system; 7. a grinding ball; 31. a cylinder; 32. a front cover; 33. a rear cover; 34. a plasma power supply grounding electrode; 35. a plasma power supply high-voltage electrode; 36. inlet and outlet holes of the tank; 41. a conductive core; 42. an outer insulation layer; 311. a flange; 312. a sealing ring; 313. a bolt; 321. a through hole; 322. a stainless steel sleeve; 323. a rubber sealing ring; 324. a vacuum valve; 325. a polytetrafluoroethylene plate; 326. a ceramic plate; 331. a blind hole; 332. a stainless steel sleeve gasket; 333. a polytetrafluoroethylene plate; 334. a ceramic plate; 411. a tightening end; 412. a discharge end; 413. a spherical structure; 421. a metal sleeve; 51. a pressure reducing valve; 52. a flowmeter; 56. an unloading valve; 541. a ball valve; 542. a ball valve; 551. a filter; 552. a filter; 571. a metal hose; and 572. a metal hose.

DETAILED DESCRIPTION OF THE EMBODIMENTS

The present invention will be described below in detail with reference to drawings and embodiments.

For the application method for producing cold field plasma discharge assisted high energy ball milled powder according to the present invention, first inputting different voltage and current to a discharge ball milling tank of a plasma assisted high energy ball milling device by using an external cold field plasma power supply, then regulating the internal atmosphere (type and pressure of a gas) of the ball milling tank through a controllable atmosphere system, and then making a discharge electrode bar in the discharge ball milling tank produce a corona or glow discharge phenomenon with controllable strength, thus realizing a plasma field high energy ball milling and assisted mechanical alloying process for the processed powder in the discharge ball milling tank. The principle is as follows: Viewed from the energy input, the single mechanical energy and the plasma in the original ball milling process are combined organically, so as to increase the effective energy input to the processed powder and process the powder in a composite way. The plasma-generated high energy particles are used to bombard the ball milled powder to transfer the energy in the form of heat to the ball milled powder, so that the temperature of the ball milled powder is instantaneously highly increased, resulting in local melting or even gasification of the powder and the so-called "hot burst" effect; with the "hot burst" effect of the plasma discharge ball mill related to the thermal properties of metal materials, the higher the melting point and the boiling point of the metal, the greater the thermal conductivity, the specific heat and the dissolution gasification heat, and the more difficult it is to induce the "electric hot burst". The dielectric barrier discharge assisted high energy ball milling device is mainly based on two significant effects produced by the plasma including a thermal effect and an excitation effect. Considering the two aspects including the powder refinement and the mechanical alloying in the high energy ball milling, the introduction of plasma into the high energy ball milling can have a great effect on improving the mechanical alloying technology.

First, in the aspect of powder refinement: The cold field plasma has an extremely high electron temperature, but its overall macro temperature is not high and can be controlled below the metal phase transformation point and even at room temperature, so that it can achieve instantaneous micro-area rapid heating, induce thermal stress and promote powder crushing without doing damage to the workpiece and the ball milling system; in addition, the temperature gradient generated by the ball milling tank as a plasma reactor is very large, and the powder is heated to a very high temperature under the action of the plasma, while the relatively low-temperature grinding ball immediately makes the powder quickly quenched, which is very beneficial to ultrafine particle synthesis and very easy to achieve high supersaturation; more importantly, the plasma is produced by pure gas ionization, and thus the heat source is pure and clean and will not be like a chemical flame that contains incompletely burnt carbon black and other impurities, which is important for the preparation of the high purity powder.

Second, in the aspect of mechanical alloying: Due to the thermal effect of the plasma, the atomic diffusion capacity will be stronger than that in an ordinary ball mill, which is beneficial to the ball milling phase transformation; more importantly, the plasma produces the excitation effect: the plasma, as an active gaseous substance in a highly ionized state, generates a large number of ions, electrons, excited atoms and molecules, and free radicals, etc. in the reaction chamber, and can itself provide very active chemical particles for the chemical reaction; and the plasma can use the energy transferred by the electric field to bombard and sputter the surface of the material, thereby changing the nature and chemical reactivity of the material, enhancing the activity of the ball milled powder, and driving the powder alloying reaction to proceed under the impact and stir of the grinding ball. That is, by introducing plasma, it is possible to make the alloying reaction, which originally takes an extremely long time to occur in the ordinary ball milling process, become easier at a temperature close to the room temperature.

Figure 1B:
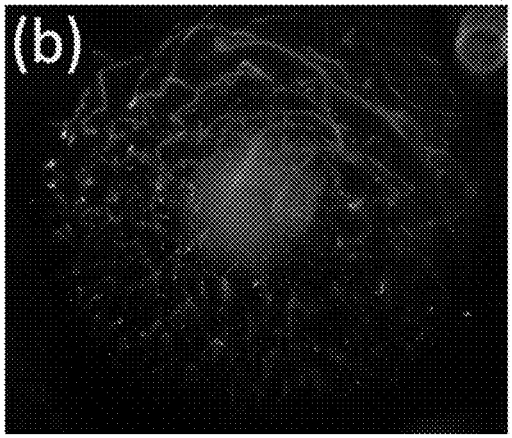

FIGS. 1*a* and 1*b* show the dielectric barrier discharge plasma photographs in the ball milling process of the present invention.

Figure 2:
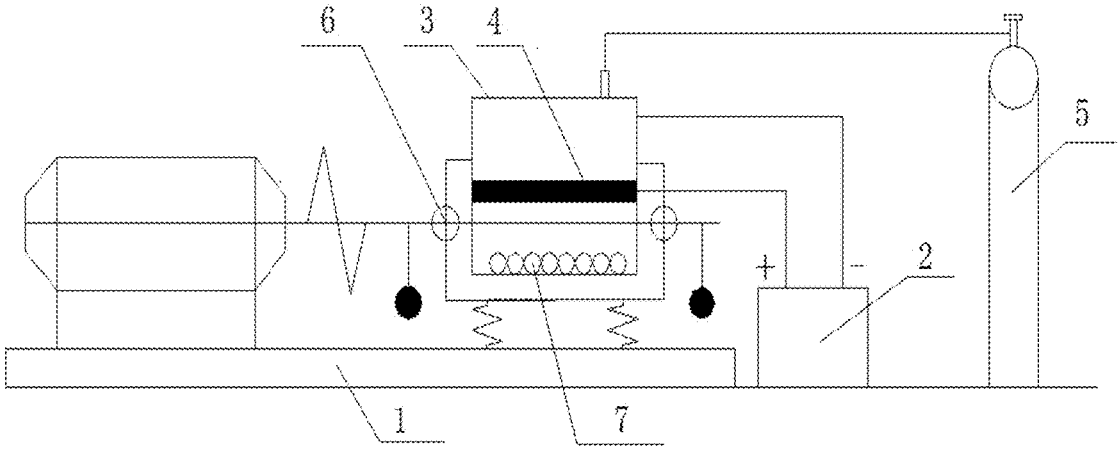
FIG. 2 is a schematic view of the structure of the plasma assisted high energy ball milling device according to the present invention.
Figure 3A:
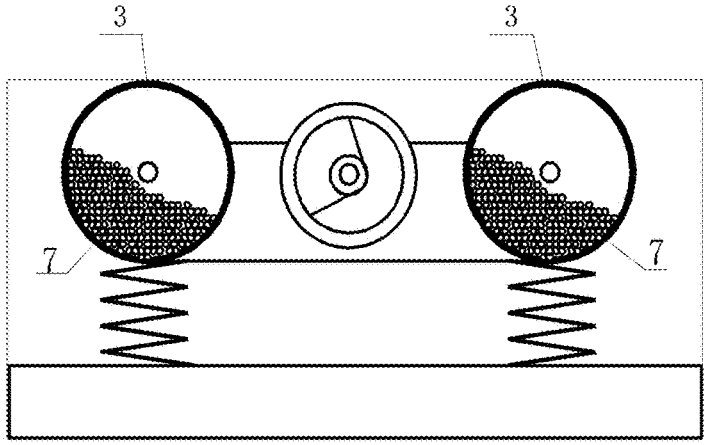
FIGS. 3*a* and 3*b* are a schematic view of the structure of the double-cylinder milling main engine and the eccentric milling main engine of the vibrating ball mill according to the present invention.
Figure 3B:
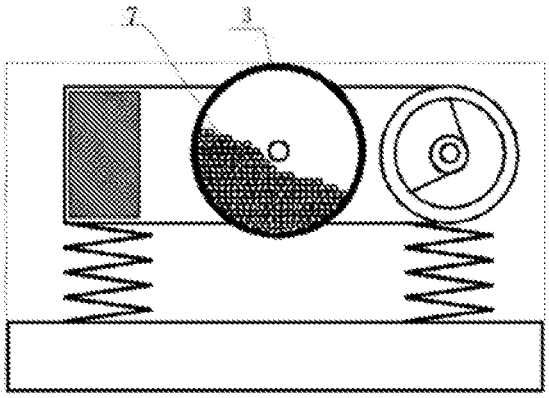

The plasma assisted high energy ball milling device of the present invention, as shown in FIG. 2, comprises six components, i.e., a vibrating high energy ball milling main engine 1, an external cold field plasma power supply 2, a discharge ball milling tank 3, a discharge electrode bar 4, a controllable atmosphere system 5 and a cooling system 6. As shown in the example of FIG. 3*a* of the present invention, the vibrating high energy ball milling main engine 1 can also be in the form of an eccentric vibrating mill, as shown in FIG. 3*b*, in addition to the form of a double-cylinder vibrating mill.

Figure 4:
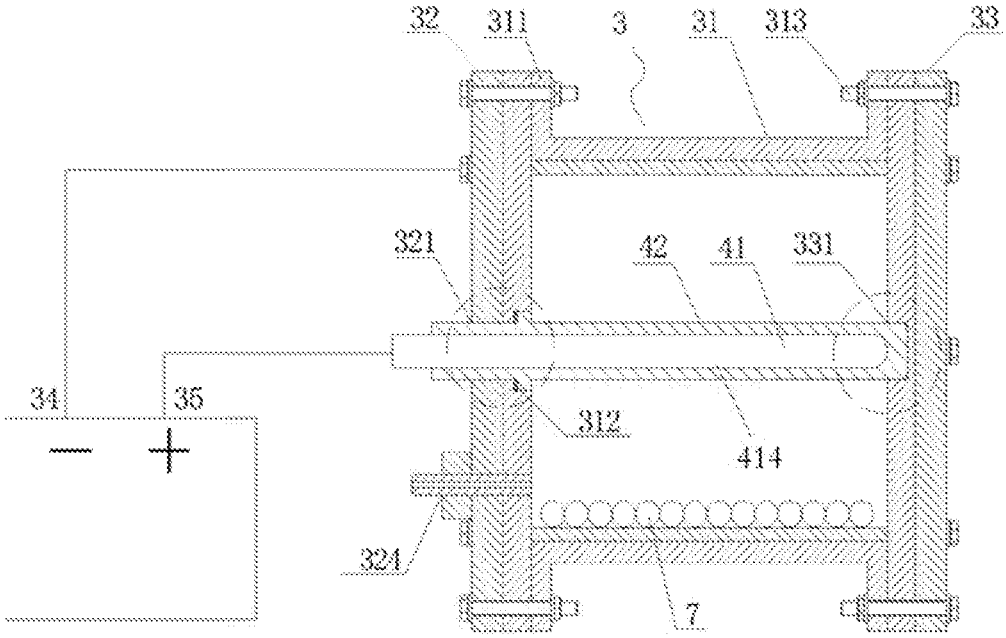
FIG. 4 is a schematic view of the structure of the discharge ball milling tank of the plasma assisted high energy ball milling device according to the present invention.

As shown in FIG. 4, the discharge ball milling tank 3 of the present invention comprises a connecting cylinder 31, a front cover 32, a rear cover 33, and a plasma power supply negative electrode 34 connected to the discharge ball milling tank 3; the discharge electrode bar 4 of the present invention, in the form of a cylindrical rod, is composed of an inner conductive core 41 made of iron (copper) and an outer insulation layer 42 made of polytetrafluoroethylene; the inner conductive core 41, as an electrode for plasma discharge, is connected to a plasma power supply positive electrode 35, and the outer insulation layer 42 is present as a discharge dielectric barrier layer. A fitting gap 414 is between the conductive core 41 and the outer insulation layer 42.

Figure 5:
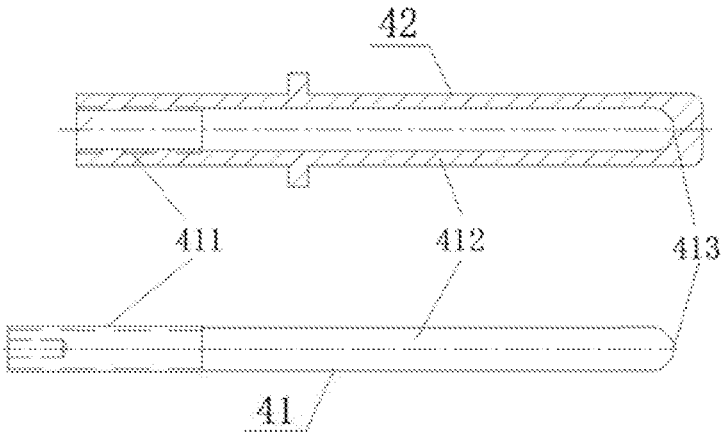
FIG. 5 is a schematic view of the structure of the discharge electrode bar of the present invention.

As shown in FIG. 5, a tightening end 411 of the conductive core 41 made of iron (copper) in the discharge electrode bar 4 threadedly fits in with the outer insulation layer 42 made of polytetrafluoroethylene, a discharge end 412 fits in with the outer insulation layer 42 by having a bare rod structure, a fitting gap 414 between the conductive core 41 and the outer insulation layer 42 is filled with a heat-resistant adhesive, and the top of the conductive core 41 fits in with a medium in the outer insulation layer 42 by having a spherical structure 413; the outer insulation layer 42 made of a high purity alumina ceramic material, composing the discharge electrode bar 4 together with the inner conductive core 41 made of iron (copper), is formed by a direct deposition method or a micro-arc oxidation method.

Figure 6:
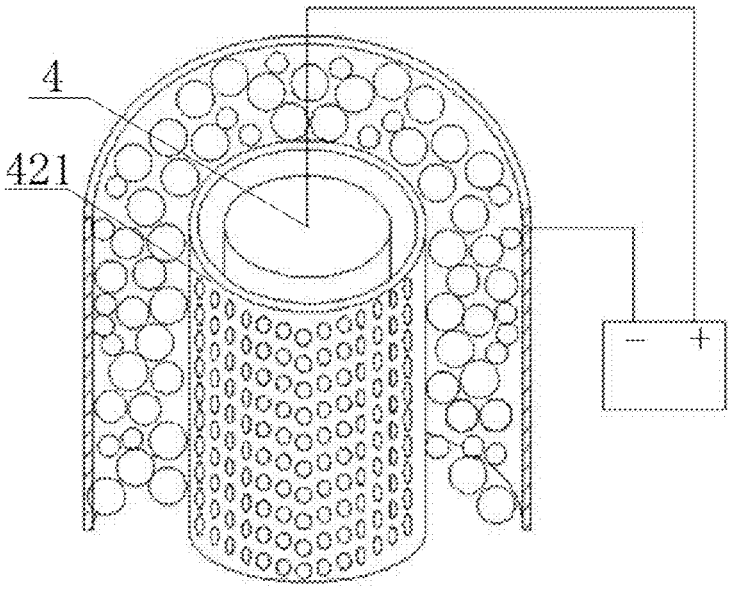
FIG. 6 is a schematic view showing the installation of the discharge ball milling tank and the discharge electrode bar with a metal sleeve according to the present invention.

The outer insulation layer 42 of the cylindrical rod-shaped discharge electrode bar 4 of the present invention is alternatively made of a high purity alumina ceramic material; if the discharge electrode bar 4 with the outer insulation layer 42 made of the high purity alumina ceramic material is used, a metal sleeve 421 with meshes is provided outside around the outer insulation layer 42, as shown in FIG. 6.

The external cold field plasma power supply 2 of the ion assisted high energy ball milling device of the present invention converts a mains supply current into a high-frequency current by using a high-voltage AC power supply in a conversion mode of AC-DC-AC, wherein an FM control mode is used for the DC-AC conversion, the working frequency is adjustable in the range of 1-20 kHz, and the power supply output voltage is in the range of 1-30 kV.

Figure 7:
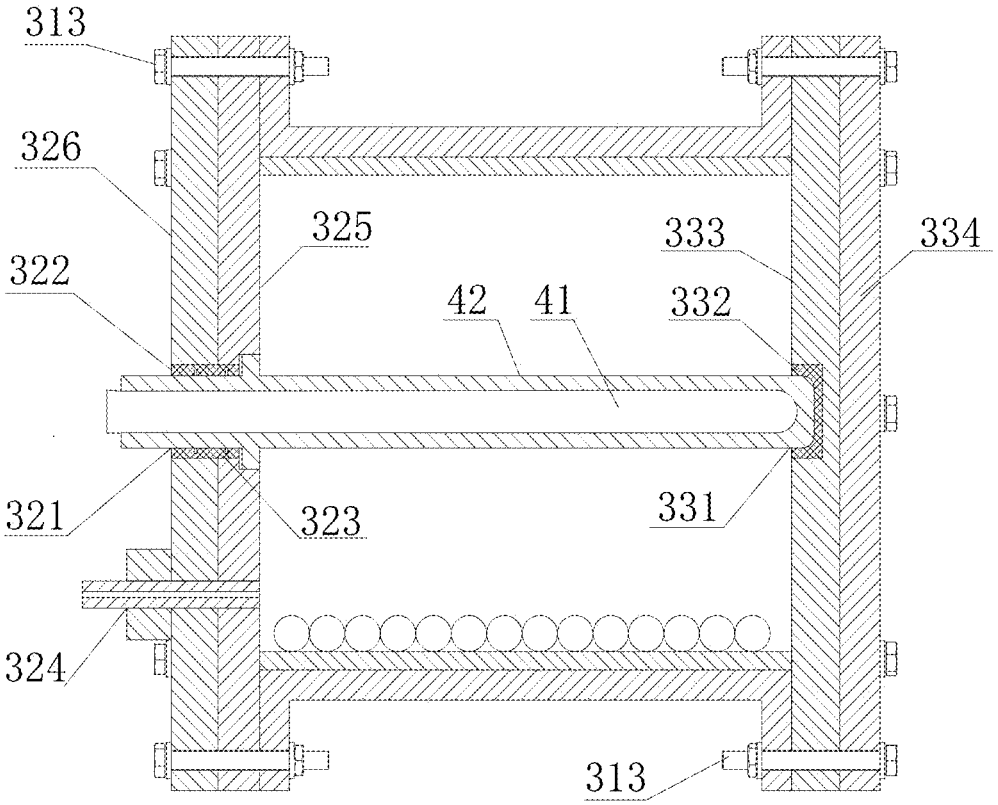
FIG. 7 is a schematic view of the installing structure of the discharge ball milling tank and the discharge electrode bar according to the present invention.

As shown in FIG. 7, flanges 311 on both ends of the cylinder 31 of the discharge ball milling tank 3 of the present invention are sealedly connected to the front cover 32 and the rear cover 33 through a sealing ring 312 and a bolt 313, respectively, with a through hole and a blind hole for fixing the discharge electrode bar provided in a central position of the front cover 32 and the rear cover 33, respectively. A stainless steel sleeve 322 and a rubber sealing ring 323 are embedded in the through hole 321 of the front cover 32, and a stainless steel sleeve gasket 332 is embedded in the blind hole 331 of the inner side of the rear cover 33; and the front cover 32 of the discharge ball milling tank 3 is provided on its outer end face with a vacuum valve 324.

Figure 8:
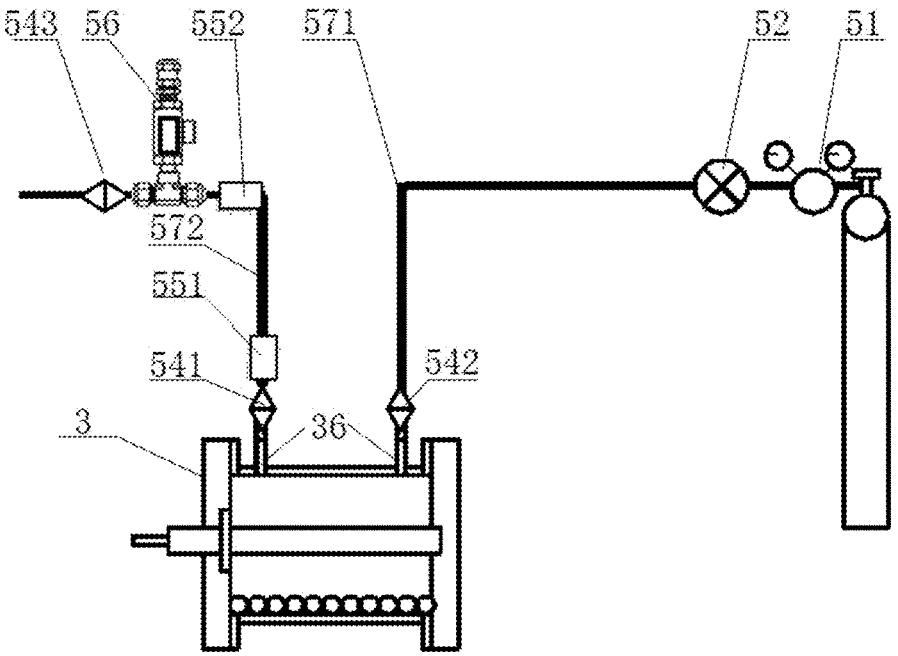
FIG. 8 is a schematic view of the structure of the controllable atmosphere system and the discharge ball milling tank according to the present invention.

For the plasma assisted high energy ball mill of the present invention, as shown in FIG. 8, the controllable atmosphere system 5, mounted above the inlet and outlet holes 36 of the discharge ball milling tank 3, can independently regulate ball milling effects of the plasma on the processed powder under different atmospheric pressure and in various atmospheres of argon, nitrogen, ammonia, hydrogen and oxygen.

The device of the present invention is operated according to the following steps:

(1) Putting the grinding ball and the powder to be processed into the ball milling tank, and mounting the dielectric barrier discharge electrode bar in the center of the ball milling tank to bring the electrode bar into contact with the grinding ball and the powder to be processed, and then sealing and fixing the ball milling tank with the end cap thereof;

(2) vacuumizing the sealed ball milling tank by a vacuum valve to a negative pressure, and then introducing the required discharge gas medium, such as argon, nitrogen, argon, methane or oxygen, into the ball milling tank with the vacuum valve; wherein the inlet gas pressure can be controlled in the range of 0.01-1 MPa;

(3) connecting the ball milling tank and the electrode bar conductive core to the positive and negative electrodes of the plasma power supply, respectively, wherein the electrode bar conductive core is connected to the positive electrode of the plasma power supply, and the ball milling tank is connected to the negative electrode of the plasma power supply; and (4) switching on the plasma power supply, adjusting the plasma power supply discharge parameters according to the discharge gas medium and its pressure to a voltage of 3-30 KV and a frequency of 5-40 KHz to generate an electric field, and starting the ball mill; with changes of the vibration frequency or rotational speed of the ball mill, changing the position of the electrode bar relative to the grinding ball in the ball milling tank for corona discharge or glow discharge plasma assisted high energy ball milling; wherein the corona plasma is mainly used to assist the powder refinement, and the glow discharge plasma is mainly used to assist the mechanical alloying.

With respect to the prior art, the present invention has a unique structure and advantages in terms of the design of the discharge ball milling tank, the dielectric barrier discharge electrode bar, the atmosphere control system and so on.

The discharge ball milling tank of the present invention comprises a cylinder, a front cover (double layer), and a rear cover (double layer), the ball milling tank is connected to the negative electrode of the plasma power supply, and both the sleeve and the grinding ball are in a breakover state and can be seen integrally as an electrode of the plasma discharge; wherein the front cover and the rear cover comprise a polytetrafluoroethylene layer and a ceramic layer, respectively; the cylinder of the ball milling tank, being electrically conductive, is made of a stainless steel housing lined with a cemented carbide layer; the front and rear covers are made of double-layered insulating materials such as polytetrafluoroethylene, plexiglass and ceramic plates, e.g., when polytetrafluoroethylene and ceramic plates are used together, the former is used as the inner layer to prevent the grinding ball from being crushed, and the latter is used as an outer layer to enhance the strength of the cover; the flanges on both ends of the cylinder are sealedly connected to the front cover and the rear cover through a sealing ring and more than 8 bolts, respectively, with a through hole and a blind hole for fixing the electrode bar provided in a central position of the front cover and the rear cover, respectively;

a stainless steel inner ring and a rubber sealing ring are embedded in the through hole of the front cover, and a metal sleeve is also embedded in the blind hole in the inner side of the rear cover, with the embedding structure effectively preventing the tip of the electrode bar from damaging the front and rear covers due to discharging;

the front cover is provided with a vacuum valve made of stainless steel to facilitate controlling the degree of vacuum within the ball milling tank; and with a dielectric barrier discharge electrode bar as the core device of the plasma assisted ball milling device, the discharge effect of the electrode bar is controlled by controlling the discharge voltage and power of the plasma; however, the barrier dielectric layer of the electrode bar, subjected to damage by the mechanical collision of the grinding ball and the electric field discharge in the discharge process, has an extremely bad working environment and usually gets various forms of damage in the course of use: (1) the surface of the dielectric barrier layer is prone to pinhole or small hole breakdown; (2) the dielectric barrier layer is prone to having breakdown holes in the position where it fits in with the end cover at both ends of the ball milling tank; and (3) the barrier dielectric layer suffers from cracking and large area burn due to local overheating; these damages have seriously affected the application of the discharge plasma assisted ball milling technology; in order to avoid breakdown and destruction of the dielectric barrier layer in using the electrode layer, an electrode bar with a reasonable structure must be designed and manufactured, so as to avoid the nonuniform discharge electric field and thermal field to be present in the barrier dielectric layer in the discharge ball milling process; wherein the weakest portion of the dielectric barrier layer is at the shoulder and the top of the shaft; this is mainly due to the breakdown of the barrier dielectric layer caused by the local high-intensity electric field, which is attributed to the thread fitting and the presence of the gas residual in the fitting position.

The dielectric barrier discharge electrode bar of the present invention, in the form of a cylindrical rod, is composed of a core made of iron, copper and other conductive materials, and an outer layer made of PTFE or high purity alumina ceramic and other insulating materials. The inner conductive core, as an electrode for plasma discharge, is connected to a plasma power supply positive electrode, and the outer insulating material is present as a discharge dielectric barrier layer. The present invention comprises the following three structures for extending the service life of the dielectric barrier discharge electrode bar:

(1) The electrode bar is composed of an inner iron or copper core and an outer polytetrafluoroethylene layer, wherein the tightening end threadedly fits in insulation with the outer PTFE layer, the discharge end has a bare rod structure (instead of the thread structure), a heat-resistant adhesive is fully filled in the fitting gap between the electrode layer and the polytetrafluoroethylene layer to avoid the presence of air, and the top of the electrode has a spherical structure to fit in with the outer insulating dielectric layer so as to avoid the local high intensity electric field generated by the tip discharge;

(2) the electrode bar is composed of an inner iron or copper core and an outer polytetrafluoroethylene layer, wherein polytetrafluoroethylene (the dielectric barrier layer) is deposited directly on the electrode layer to form a dielectric insulation layer which is in complete tight fitting without any gap; and (3) the electrode bar is composed of an inner iron or copper core and an outer high purity alumina ceramic layer that are formed by direct deposition or micro-arc oxidation, etc., wherein a metal sleeve with meshes is added between the electrode bar and the ball milling tank to prevent the ceramic from cracking in the collision process of the grinding ball, as shown in FIG. 6, with the grinding ball moving between the sleeve and the ball milling tank; a metal sleeve with meshes is added between the electrode bar and the ball milling tank, the grinding ball is located between the sleeve and the ball milling tank, the ball milling tank is connected to the negative electrode of the plasma power supply, and the ball milling tank, the grinding ball and the sleeve are electrically connected and can be seen integrally as an electrode of the plasma discharge; the positive electrode of the plasma power supply is connected with the electrode bar in the middle of the sleeve, with the electrode bar still composed of an iron or copper core and a high purity alumina ceramic layer; thus the plasma discharge will be carried out between the sleeve and the electrode bar, and the milled powder can enter the sleeve through the meshes to get the discharge plasma treatment; the specific parameters of the metal sleeve 421 are generally as follows: the sleeve has a thickness of 3 mm, an outer diameter of 40 mm, and a small hole diameter of 3 mm that is smaller than the minimum grinding ball diameter; therefore, the powder can freely go into and out of the sleeve, while the grinding ball cannot enter the sleeve in the ball milling process and will not have a mechanical impact on the electrode bar.

Viewed from the experimental results of the above three improved discharge electrode bars, when the rotational speed of the motor reaches 1000 rpm/min and the grinding ball in the tank weighs 7.5 kg, the life of the electrode bar prepared by the latter two methods can reach about 30-50 h, which is unmatched by other ordinary electrode bars.

In addition, the present invention has a unique structure and advantages over the prior art in the design of the controllable atmosphere system. This system is achieved by the following technical solutions:

(1) A pressure reducing valve 51 and a flowmeter 52 are used to control the input pressure and flow of gas.

(2) Ball valves 541 and 542 are provided at the inlet and outlet of the discharge ball milling tank 3 to control the gas emission and introduction.

(3) The filters 551 and 552, used for filtering the powder to reduce emission of the powder caused by gas flow, adopt the double filtration mode since the filtering accuracy does not reach the nanometer level.

(4) An unloading valve 56, through an adjustment nut thereon, can be used to adjust the spring pressure in the valve by adjusting the height of the nut in the case of ventilation. When the gas pressure exceeds the spring pressure, the spring will be raised to exhaust outward (unloading); when the gas pressure is less than the spring pressure, the valve will close to achieve the purpose of controlling the internal pressure of the discharge ball milling tank.

(5) Metal hoses 571 and 572 are used for installation to the ball milling tank to reduce the effect of vibration on other parts of the gas channel, in particular the spring portion of the unloading valve. The valve parts other than the hose parts should be fixed to reduce the impact of vibration.

(6) The input pressure is required to be slightly greater than the rated control gas pressure in use, so as to ensure the gas flow and pure atmosphere in the discharge ball milling tank. Thus the effect of gas type, gas flow and the like on the plasma can be achieved.

The controllable atmosphere system achieves the effect of different gas pressure and atmosphere on the plasma discharge intensity and thickness, thus providing different atmosphere parameters for the plasma assisted ball milling of different powders.

Compared with the prior art, the present invention has the following advantages and beneficial effects in the powder mechanical alloying:

(1) Powder can be heated fast, deformed greatly, and refined in a short duration. With the same process parameters, the particle size of the plasma assisted ball milled powder produced by using this method can reach nanoscale and is distributed narrowly, while the particle size of the ordinary ball milled powder is at the micron level and distributed widely.

(2) The mechanical alloying process is promoted. The plasma assisted high energy ball milling has the addition of the plasma energy based on the conventional mechanical energy, which will inevitably increase the surface energy and interface energy of the powder and enhance the reactivity of the powder at the same time of efficiently refining the powder, and the pure thermal effect of the plasma is also advantageous for promoting diffusion and alloying reaction.

(3) With the method of the present invention, when the discharge gas medium is an organic gas, the in situ surface modification of the powder can be achieved while the powder is refined.

(4) The process of the present invention is easy to realize, and has high processing efficiency, and can effectively shorten the time required for powder refinement and mechanical alloying and save energy, so that the high energy ball milling technology can realize the actual material preparation and mass production, having a broad application prospect.

The plasma assisted ball milling can be more efficient than the ordinary ball milling in refining metal powder, and is especially an efficient way to prepare nano-metal powder. The test results showed that: The iron powder was refined to a minimum greater than 1 μm after being milled by the ordinary ball milling for 60 h at room temperature; the iron powder was refined to below 1 μm after being milled by low temperature ball milling at −20° C. for 30 h; 24 kV plasma assisted ball milling, having the highest efficiency, only spent 10 h to produce the nano iron powder having an average particle size of 103.9 nm. For aluminum powder and tungsten powder, they had the results similar to the iron powder: most of the aluminum powder reached 10-50 μm after being milled by the ordinary ball milling for 15 h, while the aluminum powder reached an average particle size of 128.7 nm after being milled by the plasma assisted ball milling for 15 h; the tungsten powder reached a particle size of 0.5-3 μm after being milled by the ordinary ball milling for 3 h, while the tungsten powder reached an average particle size of 101.9 nm after being milled by the plasma assisted ball milling for 3 h. In the process of milling pure metal by the plasma assisted ball milling, it is the thermal properties of metal materials that affect the "hot burst" effect of plasma. The higher the melting point and the boiling point of the metal, the greater the thermal conductivity, the specific heat, the melting heat and the gasification heat, and the more difficult it is to induce the "electric hot burst", which also directly affects the content of the powder below 10 nm in the plasma assisted ball milled metal powder. For example, the melting point of tungsten is extremely high, and the content of the tungsten nanoparticles below 10 nm resulted from the "hot burst" effect produced by the plasma was only 10.5%. Although aluminum has greater thermal conductivity than iron, since its melting point is too low, the content of the aluminum nanoparticles below 10 nm resulted from the "hot burst" effect produced by the plasma was 27.3%, slightly higher than the content of the iron nanoparticles below 10 nm in the iron powder (25.2%).

The plasma assisted ball milling can activate the reaction powder more efficiently than the ordinary ball milling and promote the mechanical chemical reaction, e.g., the powder plasma assisted ball milling only spent 3 h to effectively activate the tungsten powder+graphite powder, and the subsequent 1100° C. insulation treatment only spent 1 h to make all the tungsten powder carbonized into the nano-WC powder having a particle size of 100 nm and an average grain size of about 50 nm, with the carbonization temperature lower than the conventional carbonization temperature by 500° C. The activation mechanism of plasma assisted milling is that, on the one hand, the dielectric barrier discharge effect and the impact effect of the plasma make the internal energy of the powder itself increase, and also more on the other hand, a nano-scale fine composite structure is formed among the reaction powder because of the dielectric barrier discharge effect in the ball milling process. This fine composite structure, on the one hand, can greatly reduce the temperature required for subsequent reactions, and on the other hand, can promote improvement of the reaction to make the product pure.

The discharge plasma assisted ball milling, as a new technology, significantly reduces the reaction activation energy, refines grains, greatly increases the powder activity, improves the particle distribution uniformity, enhances the combination at the interface between the powder and the substrate, promotes solid ion diffusion, induces a low temperature reaction, thereby improving various performances of the materials, and is thus an energy-saving and efficient material preparation technology. By providing greater and effective energy input for the processed powder, the discharge plasma assisted ball milling accelerates the powder refinement, promotes the mechanical alloying process, and greatly improves the processing efficiency of the ball mill, relating to machinery, materials and electricity and other fields with a wide range of research space. Currently, the present invention has a broad industrial application prospect in the direction of cemented carbide, lithium ion batteries and hydrogen storage alloy, etc.

The application method for the cold field plasma discharge assisted high energy ball milled powder according to the present invention is illustrated below with reference to examples.

The discharge electrode bar of the plasma assisted high energy ball mill of the present invention, in the form of a cylindrical rod, is composed of a core made of iron, copper and other conductive materials, and an outer layer made of PTFE or high purity alumina ceramic and other insulating materials; the inner conductive core, as an electrode for plasma discharge, is connected to a plasma power supply positive high-voltage electrode, and the outer insulating material is present as a discharge dielectric barrier layer. Since the life and performance of the electrode bar directly determine the work efficiency of the ball mill, we enumerated three electrode bars in the present patent and an ordinary electrode bar (the iron core was directly extruded into the interference-fit polytetrafluoroethylene with a blind hole) for comparison of the working life. The working conditions used were as follows: a discharge voltage at 15 KV, a discharge current at 1.5 A, an excitation block with dual amplitude at 8 mm, a ball-material ratio at 50:1, and the grinding ball made of cemented carbide or stainless steel. The results were shown in FIG. 1.

Example 1

Step 1: Using an electrode bar composed of an inner copper core and an outer polytetrafluoroethylene layer, wherein the tightening end threadedly fitted in insulation with the outer PTFE layer, the discharge end had a bare rod structure (instead of the thread structure), a heat-resistant adhesive was fully filled in the fitting gap between the electrode layer and the polytetrafluoroethylene layer to avoid the presence of air, and the top of the electrode had a spherical structure to fit in with the outer insulating dielectric layer. Mounting the electrode bar in a 4 L ball milling tank, putting the grinding ball and the powder to be processed into the ball milling tank, and mounting the dielectric barrier discharge electrode bar in the center of the ball milling tank to bring the electrode bar into contact with the grinding ball and the powder to be processed, and then sealing and fixing the ball milling tank with the end cap thereof; wherein the electrode bar had a diameter of 25 mm, and the grinding ball was made of a cemented carbide material and weighed 7.5 kg at a ball-material ratio of 50:1;

Step 2: vacuumizing the sealed ball milling tank by a vacuum valve to a negative pressure, and then introducing by the vacuum valve the required discharge argon, with the introduced gas reaching a pressure of 0.1 MPa;

Step 3: connecting the ball milling tank and the electrode bar conductive core to the positive and negative electrodes of the plasma power supply, respectively, wherein the electrode bar conductive core was connected to the positive electrode of the plasma power supply, and the ball milling tank was connected to the negative electrode of the plasma power supply; the working conditions used were as follows: a discharge voltage at 15 KV, a discharge current at 1.5 A, an excitation block with dual amplitude at 8 mm, and a rotational speed at 1200 rpm; and starting the ball mill.

The results showed that the service life of the electrode bar could reach about 20 h.

Example 2

Steps 1 and 2: Same as Example 1; and

Step 3: same as Example 1, except that the rotational speed of the ball mill was 960 rpm.

The results showed that the service life of the electrode bar could reach about 30 h.

Example 3

Step 1: Same as Example 1, except that the ball milling volume was 0.15 L, the diameter of the electrode bar was 20 mm, and the grinding ball was made of stainless steel;

Step 2: same as Example 1; and

Step 3: same as Example 1, except that the discharge current was 1.0 A, and the rotational speed of the ball mill was 960 rpm.

The results showed that the service life of the electrode bar could reach about 35 h.

Example 4

Step 1: Using an electrode bar composed of an inner copper core and an outer polytetrafluoroethylene layer, wherein polytetrafluoroethylene (the dielectric barrier layer) was deposited directly on the electrode layer; mounting the electrode bar in a 4 L ball milling tank, putting the grinding ball and the powder to be processed into the ball milling tank, and mounting the dielectric barrier discharge electrode bar in the center of the ball milling tank to bring the electrode bar into contact with the grinding ball and the powder to be processed, and then sealing and fixing the ball milling tank with the end cap thereof; wherein the electrode bar had a diameter of 25 mm, and the grinding ball was made of a cemented carbide material and weighed 7.5 kg at a ball-material ratio of 50:1;

Step 2: vacuumizing the sealed ball milling tank by a vacuum valve to a negative pressure, and then introducing by the vacuum valve the required discharge argon; wherein the introduced gas reached a pressure of 0.1 MPa;

Step 3: connecting the ball milling tank and the electrode bar conductive core to the positive and negative electrodes of the plasma power supply, respectively, wherein the electrode bar conductive core was connected to the positive electrode of the plasma power supply, and the ball milling tank was connected to the negative electrode of the plasma power supply; the working conditions used were as follows: a discharge voltage at 15 KV, a discharge current at 1.5 A, an excitation block with dual amplitude at 8 mm, and a rotational speed at 1200 rpm; and starting the ball mill.

The results showed that the service life of the electrode bar could reach about 15 h.

Example 5

Steps 1 and 2: Same as Example 4; and

Step 3: same as Example 4, except that the rotational speed of the ball mill was 960 rpm.

The results showed that the service life of the electrode bar could reach about 25 h.

Example 6

Step 1: Same as Example 4, except that the ball milling volume was 0.15 L, the diameter of the electrode bar was 20 mm, and the grinding ball was made of stainless steel;

Step 2: same as Example 4; and

Step 3: same as Example 4, except that the discharge current was 1.0 A, and the rotational speed of the ball mill was 960 rpm.

The results showed that the service life of the electrode bar could reach about 30 h.

Example 7

Step 1: Using an electrode bar composed of an inner copper core and outer ceramic, wherein a metal sleeve with meshes was added between the electrode bar and the ball milling tank, with the grinding ball moving between the sleeve and the ball milling tank; mounting the electrode bar in a 4 L ball milling tank, putting the grinding ball and the powder to be processed into the ball milling tank, and mounting the dielectric barrier discharge electrode bar in the center of the ball milling tank to bring the electrode bar into contact with the grinding ball and the powder to be processed, and then sealing and fixing the ball milling tank with the end cap thereof; wherein the electrode bar had a diameter of 25 mm, and the grinding ball was made of a cemented carbide material and weighed 7.5 kg at a ball-material ratio of 50:1;

Step 2: vacuumizing the sealed ball milling tank by a vacuum valve to a negative pressure, and then introducing by the vacuum valve the required discharge argon; wherein the introduced gas reached a pressure of 0.1 MPa;

Step 3: connecting the ball milling tank and the electrode bar conductive core to the positive and negative electrodes of the plasma power supply, respectively, wherein the electrode bar conductive core was connected to the positive electrode of the plasma power supply, and the ball milling tank was connected to the negative electrode of the plasma power supply; the working conditions used were as follows: a discharge voltage at 15 KV, a discharge current at 1.5 A, an excitation block with dual amplitude at 8 mm, and a rotational speed at 1200 rpm; and starting the ball mill.

The results showed that the service life of the electrode bar could reach about 25 h.

Example 8

Steps 1 and 2: Same as Example 7; and

Step 3: same as Example 7, except that the rotational speed of the ball mill was 960 rpm.

The results showed that the service life of the electrode bar could reach about 36 h.

Example 9

Step 1: Same as Example 7, except that the ball milling volume was 0.15 L, the diameter of the electrode bar was 20 mm, and the grinding ball was made of stainless steel;

Step 2: same as Example 7; and

Step 3: same as Example 7, except that the discharge current was 1.0 A, and the rotational speed of the ball mill was 960 rpm.

The results showed that the service life of the electrode bar could reach about 40 h.

The examples in the present invention used a high rotational speed (960-1200 rpm), a high grinding ball filling ratio (65% to 75% of the volume of the ball milling tank), and a cemented carbide grinding ball to increase the vibration strength and impact force on the electrode bar, so as to test the service life of the electrode bar. In terms of the life of the electrode bars of different structures, the three electrode bars in the present invention are substantially close to or reach a continuous service life of 30 h, which is much longer than that of the ordinary electrode bars. If the grinding ball parameters including a low rotational speed and a low ball-material ratio are used, the life of the electrode bar will be further greatly improved. This greatly improves the efficiency of the ball mill and increases the possibility of industrial application promotion.

TABLE 1

Comparison of the service life of electrode bars with different structural designs

| Preparation method of the discharge electrode bar | Volume of the ball milling tank (liter) | Weight of the grinding ball (kilogram) | Rotational speed (rpm) | Service life of the electrode bar (hour) |
|---|---|---|---|---|
| Example 1 | 1.5 | 7.5 | 1200 rpm | 20 |
| Example 2 | 1.5 | 7.5 | 960 rpm | 30 |
| Example 3 | 0.15 | 0.3 | 960 rpm | 35 |
| Example 4 | 1.5 | 7.5 | 1200 rpm | 15 |
| Example 5 | 1.5 | 7.5 | 960 rpm | 25 |
| Example 6 | 0.15 | 0.3 | 960 rpm | 30 |
| Example 7 | 1.5 | 7.5 | 1200 rpm | 25 |
| Example 8 | 1.5 | 7.5 | 960 rpm | 36 |
| Example 9 | 0.15 | 0.3 | 960 rpm | 40 |
| Contrast | 1.5 | 7.5 | 1200 rpm | 4 |
| example: An | 1.5 | 7.5 | 960 rpm | 6 |
| electrode bar | 0.15 | 0.3 | 960 rpm | 7 |
| without any treatment | | | | |

An example of the preparation of cemented carbide using the plasma assisted ball milling of the present invention In order to further validate the feasibility and efficiency advantages of the device of the present invention, we used a WC—Co cemented carbide material with a high melting point and high hardness as a ball milled object. The existing research of preparation of the nano-cemented carbide powder by the high energy ball milling mainly includes three processes, i.e., milling, carbonizing and molding, wherein the milling and carbonizing processes are important foundation for the entire preparation of the WC—Co based cemented carbide. The specific steps are as follows: (1) First using the high energy ball milling method to prepare the ultrafine W—C mixture; (2) then carbonizing the prepared W—C mixture to produce the ultrafine tungsten carbide (WC); and (3) finally adding Co on the basis of the produced WC before the high energy ball milling to make WC and Co mixed uniformly. But this method still requires a longer ball milling time, and the prepared composite powder is decarburized seriously. The discharge plasma assisted ball milling method of the present invention, together with the pressed sintering, can prepare the WC—Co cemented carbide with high strength and toughness by the carbonizing-sintering integrated synthesis method, overcoming the defects of a cumbersome production process and large energy consumption of the cemented carbide, and effectively improving the purity of the product.

The use of dielectric barrier discharge plasma assisted high energy ball milling is realized through the following technical solution:

(1) Putting the grinding ball, a certain ratio of W, C, Co grain growth inhibitors and the additional carbon supplement mixed powder and other raw materials into the ball milling tank, and adding an appropriate amount of a ball milling control agent (anhydrous ethanol, etc.);

(2) inserting the electrode bar into the ball milling tank through the end cap thereof, fastening the end cap of the ball milling tank, and then connecting the end cap and the electrode bar respectively to both electrodes of the plasma power supply, wherein the electrode bar is connected to the positive high-voltage electrode of the plasma power supply, and the front cover is connected to the negative grounding electrode of the plasma power supply;

(3) vacuumizing the sealed ball milling tank by a vacuum valve to a negative pressure at 0.01-0.1 Pa, or vacuumizing to a negative pressure at 0.01-0.1 Pa before introducing by the vacuum valve the discharge gas medium, until the pressure in this ball milling tank is 0.01-0.1 MPa;

(4) switching on the plasma power supply, adjusting the discharge parameters according to the discharge gas medium and its pressure to make the voltage of the plasma power supply at 3-30 KV and the frequency at 5-40 KHz for achieving corona discharge, and starting the ball mill to make the ball milling tank and the grinding ball collide with each other, thus changing the position of the electrode bar relative to the grinding ball in the ball milling tank to carry out different types of corona discharge plasma high energy ball milling, so as to obtain the W—C—Co based alloy powder;

(5) press-forming the W—C—Co-based alloy powder to produce a green body; and (6) sintering the green body in a heat source environment to prepare the W—C—Co cemented carbide.

In order to better realize the present invention, the raw materials of W, C, Co, VC or $V_2O_5$ in Step (1) were prepared according to the ratio indicated by WC—XCo—YVC or WC—XCo—Y $V_2O_5$ (the grain growth inhibitor oxide was added according to the amount required for the formation of the corresponding carbides after the carbonization thereof), wherein the value range of X was $3<X<20$, and the value range of Y was $0.09<Y<2.4$, with the amount of X and Y indicated by weight percent.

The amount of C in the mixed powder, in addition to the theoretical amount of carbon required for complete carbonation of W, also includes the amount of an additional carbon supplement, which has a mass ratio relative to the C raw material from 7.5% to 15%.

The press-forming is in the form of unidirectional molding at a unit pressure of 35-1000 MPa.

The heat source environment is a vacuum/low pressure sintering furnace, and has a temperature from 1320° C. to 1480° C.

The present invention has the following advantages in comparison with the conventional technology for preparing the cemented carbide:

(1) The W, C, Co raw materials have large deformation, short refinement time, and short lamellarization time, and can refine the powder to the nanometer level faster compared with other ball milling methods;

(2) the method is conducive to the progress of the carbonation reaction, and greatly improves the surface energy, the interface energy, reactivity, and so on of the powder after processing the W, C, Co raw materials, and the thermal effect of the plasma is beneficial for the diffusion and solid state reaction among W, C and Co, which is conducive to the subsequent sintering molding of the cemented carbide;

(3) directly pressing the W, C, Co alloy powder into a green body, substituting the carbonation-sintering integrated technology for the sintering molding technology in the traditional process including first carbonizing the W powder and then making the WC—Co mixed powder into a green body; the present invention has only one heating process from room temperature to high temperature, while the carbonization of the W powder and the sintering of the mixed powder in the conventional process are respectively subjected to one heating process from room temperature to high temperature, and thus the present invention can greatly reduce energy consumption; and (4) compared with the traditional process including first carbonizing W and then ball milling the grain growth inhibitor together with WC and Co, the present invention, by adding the grain growth inhibitor (VC or $V_2O_5$) in the process of milling W, C, Co by the dielectric barrier discharge plasma ball milling, can increase the distribution uniformity of the grain growth inhibitor, and play a role in inhibiting the WC grain growth in the process of WC formation, having a good effect of suppressing the growth of WC grains; in addition, the present invention decreases the high temperature carbonation steps, and largely reduces the cost.

Figure 9:
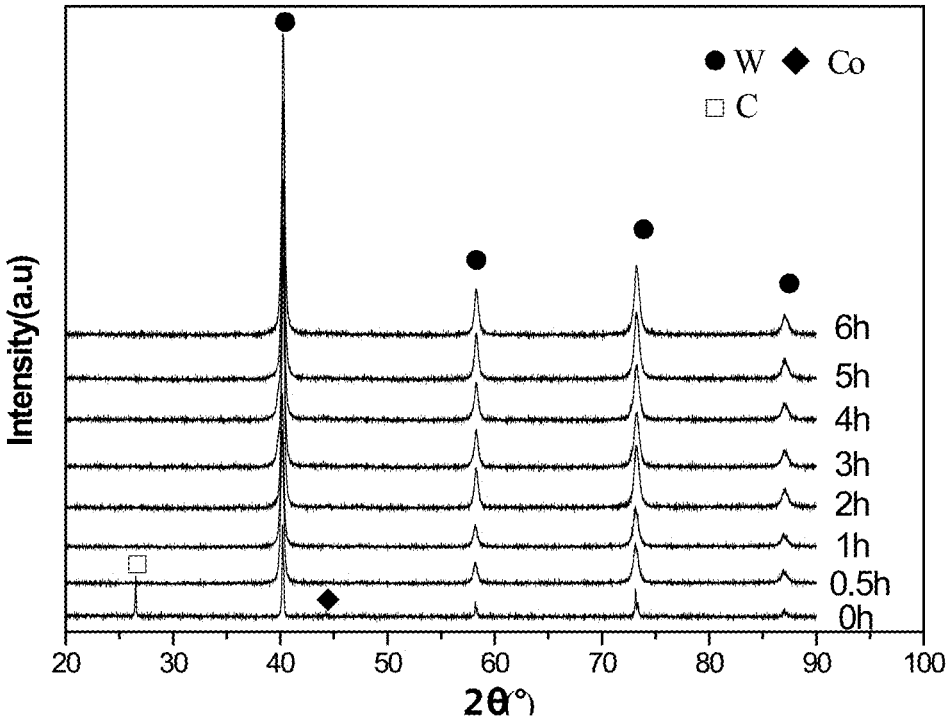
FIG. 9 shows an XRD pattern of the W—C-10Co powder (BPR=50:1) obtained at different ball milling times according to the present invention.

We examined the influence of the different ball milling time on the grain size, as shown in FIG. 9. It could be seen from the XRD pattern that, the diffraction peak of the mixed powder when DBDP had been milled for 6 h was still mainly of W without generation of WC, indicating that milling DBDP for 6 h was not enough to make W carbonized. As the milling time increased, the diffraction peak of W was broadened, especially at 0.5 h. For the (211) plane of W calculated by the Voigt function method, the grain size after milling for 0.5 h changed obviously and reached 43 nm or so. The grain size after milling for 1 h to 6 h was somewhat reduced, but changed not obviously. This indicates that DBDP ball milling can quickly refine the W grain size to a stable level, more efficient than the ordinary high energy ball milling.

From the DSC curve of the W—C-10Co mixed powders after being milled with DBDP for 3 h, as shown in FIG. 10, we could find that the endothermic peak at about 650° C. was caused by the reduction reaction by carbon of the small amount of $WO_3$ produced due to oxidation in the ball milling process and the generation and escape of CO or $CO_2$ produced by the oxygen adsorbed on the surface of the powder. There was also an exothermic peak on the DSC curve in the range from 831° C. to 875° C., which may correspond to the carbonation of tungsten. In order to study the phase transition process of the reaction peak, the composite powder was heated at 700° C. and 900° C. in a comprehensive thermal analysis apparatus. It was found that both the XRD pattern of the unheated mixed powder and the XRD pattern of the mixed powder that was DBDP ball milled for 3 h and heated to 700° C. mainly included a W peak, with the α-Co peak appearing when being heated to 700° C. This was due to W and Co grain growth with the rise in temperature. It could also be seen from FIG. 10 that WC was generated when the mixed powder was heated to 900° C., but there were decarburized phases $W_2C$ and $Co_6W_6C$ and elemental W at the same time. The process can be expressed by the following reaction:

$$W+C \rightarrow WC \quad (1)$$

$$2W+C \rightarrow W_2C \quad (2)$$

$$6W+6Co+C \rightarrow Co_6W_6C \quad (3)$$

Continuing to increase the heating temperature, and heating to 1100° C. in DSC without insulation, thus obtaining the composite powders, whose XRD pattern indicated that the mesophase $W_2C$ was completely transformed into WC, the decarburization phase $Co_6W_6C$ was more obvious, and there was still a small amount of W. The corresponding reaction formula can be expressed as follows:

$$W_2C+C \rightarrow 2WC \quad (4)$$

$$WC+5W+6Co \rightarrow Co_6W_6C \quad (5)$$

Unlike other studies, there was no mesophase $Co_3W_3C$ in the decarburization phase transition process, which may be due to the facts that the DBDP ball milled powder had higher activity, oxygen in the air was more easy to be adsorbed in the milling and taking powder processes, and the flowing atmosphere of the DSC equipment would take away $CO_2$ generated in the heating process to result in more serious lack of carbon, and the powder directly reacted to generate a $Co_6W_6C$ phase more inclined to decarburization instead of producing the $Co_3W_3C$ phase with a higher carbon content than $Co_6W_6C$.

Besides, the above processes also proved that the carbon content was not easily controlled when the carbonation reaction was completed in a flowing atmosphere, which was not conducive to the formation of WC without the decarburization phase, and thus the WC—Co composite powder should be prevented from being prepared in a flowing atmosphere. Therefore, the same ball milled powder was heated to 1000° C. in a low pressure sintering furnace and held for 1 h. The results showed that the WC-10Co composite powder without the decarburization phase could be obtained under such process conditions. This was due to the fact that the low-pressure sintering furnace heating was carried out in a closed atmosphere, and would not cause lack of carbon caused by the loss of $CO_2$. In addition, with the increase of the holding time, the nonuniform carbon further diffused and reacted with $Co_6W_6C$ at high temperature to form WC and Co, with the reaction formula expressed as follows:

$$Co_6W_6C+5C \rightarrow 6WC+6Co \quad (6)$$

In addition, on the basis of the preliminary work, we also added grain growth inhibitors in preparation of the WC—Co cemented carbide to refine the WC grains and prepare the high performance cemented carbide. With the W—C—Co powder added and VC as the research object, it was found that the effect of the DBDP assisted high energy ball milling on the W—C—Co mixed powder with the addition of the grain growth inhibitor not only refined the elemental powder, but also made graphite finely coated on the surface of the W particles, so that the powder particles were in lamellar superposition, as shown in FIG. 11*a*. The DBDP assisted high energy ball milling showed a "first fast then slow" law for the refinement efficiency of the W powder, with the addition of VC able to promote the refinement of W in the milling process. After 3 hours of ball milling, the grain size of W was about 23 nm. The WC-10Co-0.6VC cemented carbide was prepared by different sintering processes, and was found to have the following results after being tested: The samples prepared by low-pressure sintering, due to the external pressure applied during the holding stage, had the sufficiently flowing liquid phase Co, which not only better filled the holes caused by gas escape, but was also uniformly distributed among the hard phases WC to have a very good bonding effect, as shown in FIG. 11*b*. The sample prepared at a pressure of 4 MPa at 1340° C. had a consistency of 99%, a Rockwell hardness reaching HRA91.8, and a transverse rupture strength TRS reaching 3348 MPa. It could be found through analysis of the fracture morphology of this sample that the fracture form of the cemented carbide was intergranular fracture.

The above embodiments are merely a few examples of the present invention and are not intended to limit the scope of implementation and rights of the present invention, and any equivalent variations and modifications in accordance with the contents set forth in this patent application are intended to be included within the scope of the present application.

What is claimed is:

1. A plasma assisted high energy ball milling device, the device comprising: a vibrating high energy ball milling main engine, an external cold field plasma power supply, a discharge ball milling tank, a discharge electrode bar, a controllable atmosphere system and a cooling system;

wherein the vibrating high energy ball milling main engine is in a form of a double-cylinder vibrating mill;

wherein the discharge ball milling tank comprises a connecting cylinder, a front cover, a rear cover, and a plasma power supply negative grounding electrode connected to the discharge ball milling tank; and wherein the discharge electrode bar, in a form of a cylindrical rod, is composed of an inner conductive core made of iron, copper, or combinations thereof and an outer insulation layer made of a pure alumina ceramic material; the inner conductive core, as an electrode for plasma discharge, is connected to a plasma power supply positive high-voltage electrode, and the outer insulation layer is present as a discharge dielectric barrier layer;

wherein a stainless steel sleeve and a rubber sealing ring are embedded in a through hole of the front cover of the discharge ball milling tank, and a stainless steel sleeve gasket is embedded in a blind hole of an inner side of the rear cover; and wherein the front cover comprises a polytetrafluoroethylene plate and a ceramic plate, and the rear cover comprises a polytetrafluoroethylene plate and a ceramic plate.

2. The plasma assisted high energy ball milling device according to claim 1, wherein the vibrating high energy ball milling main engine is alternatively in a form of an eccentric vibrating mill.

3. The plasma assisted high energy ball milling device according to claim 1, wherein the external cold field plasma power supply converts a mains supply current into a high-frequency current by using a high-voltage AC power supply in a conversion mode of AC-DC-AC, wherein an FM control mode is used for a DC-AC conversion, with a working frequency in a range of 1-20 kHz, and a power supply output voltage is in a range of 1-30 kV.

4. The plasma assisted high energy ball milling device according to claim 1, wherein a tightening end of the inner conductive core made of iron, copper, or combinations thereof in the discharge electrode bar threadedly fits in with the outer insulation layer made of a pure alumina ceramic material, a discharge end fits in with the outer insulation layer by having a bare rod structure, a heat-resistant adhesive is provided between the inner conductive core and the outer insulation layer, and a top side of the inner conductive core fits in with a medium in the outer insulation layer by having a spherical structure.

5. The plasma assisted high energy ball milling device according to claim 1, wherein the outer insulation layer made of the pure alumina ceramic material is formed by a direct deposition method or a micro-arc oxidation method.

6. The plasma assisted high energy ball milling device according to claim 1, wherein the outer insulation layer of the discharge electrode bar made of the pure alumina ceramic material is covered with a metal sleeve with meshes.

7. The plasma assisted high energy ball milling device according to claim 1, wherein the controllable atmosphere system, mounted above inlet and outlet holes of the discharge ball milling tank, can independently regulate ball milling effects of plasma on processed powder under different atmospheric pressure and in various atmospheres of argon, nitrogen, ammonia, hydrogen, and oxygen.

8. The plasma assisted high energy ball milling device according to claim 1, wherein flanges on both ends of the connecting cylinder of the discharge ball milling tank are sealedly connected to the front cover and the rear cover through a sealing ring and a bolt, respectively, with the through hole and the blind hole for fixing the discharge electrode bar provided in a central position of the front cover and the rear cover, respectively.

9. The plasma assisted high energy ball milling device according to claim 8, wherein the front cover of the discharge ball milling tank is provided on an outer end face with a vacuum valve.

* * * * *